United States Patent [19]

Steffanus et al.

[11] 4,148,245

[45] Apr. 10, 1979

[54] FLUID PROPELLANT PROJECTILE FIRING DEVICE

[75] Inventors: Robert D. Steffanus; David R. Anderson, both of Pittsburgh, Pa.

[73] Assignee: BTGCO, Coraopolis, Pa.

[21] Appl. No.: 859,868

[22] Filed: Dec. 12, 1977

[51] Int. Cl.[2] ..... F41F 1/04

[52] U.S. Cl. ..... 89/7; 89/135; 89/137; 89/191 A

[58] Field of Search ..... 89/7, 191 A, 135, 137

[56] References Cited

U.S. PATENT DOCUMENTS

| | | | |
|---|---|---|---|
| 645,932 | 3/1900 | Beck et al. | 89/7 UX |
| 1,164,876 | 12/1915 | Saylor | 89/7 X |
| 1,306,012 | 6/1919 | Jackson | 89/7 UX |
| 1,343,456 | 6/1920 | Jones | 89/7 |
| 1,383,111 | 6/1921 | Hall et al. | 89/7 |
| 1,596,057 | 8/1926 | Mallory | 89/7 |
| 2,947,221 | 8/1960 | Griffin et al. | 89/7 |
| 3,343,455 | 9/1967 | Lohr | 89/7 |
| 3,346,984 | 10/1967 | Lohr | 89/7 |

*Primary Examiner*—David H. Brown
*Attorney, Agent, or Firm*—Parmelee, Miller, Welsh & Kratz

[57] ABSTRACT

A projectile firing device utilizing a fluid propellant in which an electronic control responsive to a charging signal, cycling of the bolt in the breechblock to a fully closed position and pressure in the firing chamber below a preset value opens a valve to permit pressurized propellant to flow into the firing chamber and closes the valve and enables electronic triggering circuits when the pressure reaches the preset value. The muzzle velocity of the device may be varied by varying the pressure of the propellant in the firing chamber and the rate of fire in the automatic mode may be adjusted electronically. A spring biased injector finger carried by the bolt urges a projectile from a magazine into the bore of the barrel and retains it there to form a gas tight seal until the propellant is ignited. When no projectiles remain in the magazine, the injector finger prevents the bolt from closing completely and therefore inhibits the electronic control from recharging the firing chamber with propellant.

10 Claims, 5 Drawing Figures

FLUID PROPELLANT PROJECTILE FIRING DEVICE

BACKGROUND OF THE INVENTION

1. Field of the Invention

The invention relates to devices for firing projectiles and more particularly to such devices utilizing a fluid propellant.

2. Prior Art

Conventional projectile firing weapon systems utilize a measured amount of solid propellant confined in a shell or cartridge casing capped by the projectile and are fired by a percussion cap or primer. The casings, which are normally brass, make such ammunition expensive and heavy to carry and therefore a good deal of effort has been expended lately on developing caseless ammunition in which the solid propellant is attached directly to the projectile without a casing. This arrangement has its own special problems, such as the development of a propellant which is resistant to chipping and cracking when used in automatic weapons and under normal field conditions. Some of these weapons utilize the heat generated by rapid compression of air to ignite the solid propellant while others rely upon impact ignition.

Several types of fluid operated weapons which inherently eliminate the need for a casing have also been proposed. In some, such as those disclosed in U.S. Pat. Nos. 1,383,111 and 3,728,937, a spark or glow plug ignites the fluid propellant. In U.S. Pat. No. 2,947,221 compression ignition of the liquid propellant is utilized to fire the weapon. These prior art weapons for the most part rely upon mechanical devices for charging the fluid propellant into the firing chamber. In U.S. Pat. No. 3,728,937, the operator manually strikes one button to admit butane and another to admit oxygen to the firing chamber after the projectile has been inserted and the bolt closed manually. In U.S. Pat. No. 1,383,111 a pump action is used to charge the firing chamber and in U.S. Pat. No. 3,800,657 the liquid propellant is charged into the firing chamber from dosing chambers by pistons. U.S. Pat. No. 3,255,669 suggests that a gaseous propellant be confined in a detonation chamber which is separated from the barrel and the projectile by a valve until the trigger is pulled and the gas is ignited in order to maintain the gas pressure.

Automatic weapons in which a portion of the gases which drive the bullet down the barrel are vented back to cycle the bolt and reload another cartridge from a magazine are well known. These weapons often provide a semi-automatic mode in which the trigger must be released and resqueezed to fire the next cartridge and a fully automatic mode in which cartridges are loaded and fired continuously as long as the trigger is squeezed. Weapons of this sort are available for both cased and caseless ammunition. While most of these weapons have a fixed rate of fire, it has been suggested that the rate of fire may be varied by adjusting the bleed rate of a pneumatic cylinder connected in the mechanical mechanism.

It is an object of the present invention to provide an improved projectile firing device using a fluid propellant which is simple in design, easily constructed and serviced and is dependable. It is also an object of this invention to provide such a device which is capable of automatic or semi-automatic operation and in which the muzzle velocity and rate of fire are adjustable. Other objects of the invention will be apparent from a reading of the detailed description of a preferred embodiment which follows.

SUMMARY OF THE INVENTION

In accordance with the invention, a projectile firing device includes control means responsive to pressure in a firing chamber below a predetermined value, to a sliding bolt in the breechblock being closed and to a charging signal, for opening a valve to permit the flow of a pressurized fluid propellant into the firing chamber and for closing the valve and enabling electrical triggering means when the pressure reaches the predetermined pressure. The electrical triggering means ignites the propellant to drive a projectile down the barrel of the device. Suitably, the charging signal may be generated by initial movement of the trigger such that the propellant is charged into the firing chamber just prior to ignition and therefore does not have the opportunity to bleed off. The velocity of the projectile may be varied by adjusting the predetermined pressure to which the firing chamber is charged.

In the preferred embodiment of the invention, gases generated by ignition of the propellant are utilized to drive the bolt open as the projectile proceeds down the barrel. As the bolt is returned to the closed position by biasing means, a projectile is fed into the barrel from a magazine. When there are no projectiles remaining in the magazine as the bolt returns to the closed position, means are provided to prevent the control means from operating the valve to recharge the firing chamber with propellant. This means may take the form of a device which prevents the bolt from closing all the way. In the embodiment disclosed, an injector finger pivoted to the bolt is biased outwardly where it engages a recess in the rear of the projectile to urge it from the magazine into the barrel. The injector finger pivots with the movement of the projectile into the barrel to permit the bolt to fully close. However, when no projectiles remain in the magazine, the injector finger remains outwardly biased and prevents full closure of the bolt.

The device may include mode means selectable to a semi-automatic condition to prevent the control means from recharging the firing chamber with propellant following ignition of the propellant until the trigger is released and reactuated and selectable to an automatic condition to permit the control means to operate the valve to repeatedly recharge the firing chamber with propellant and to enable the electrical triggering means to ignite each new charge of propellant as long as the trigger remains actuated. The selectable mode means may include means when in the automatic condition to actuate electrical means to ignite propellant in the firing chamber when the trigger is released and the pressure in the firing chamber is above the preset pressure. This clears the last round out of the firing chamber at the termination of automatic fire. The selectable mode means may also include means when in the automatic condition to generate an adjustable time delay which controls operation of the trigger enabling means to adjust the rate of fire. In the disclosed device, the time delay means is responsive to the pressure in the firing chamber and delays ignition of the propellant for the adjustable time interval after the pressure reaches the preset value.

DESCRIPTION OF THE PREFERRED EMBODIMENT

Figure 1:
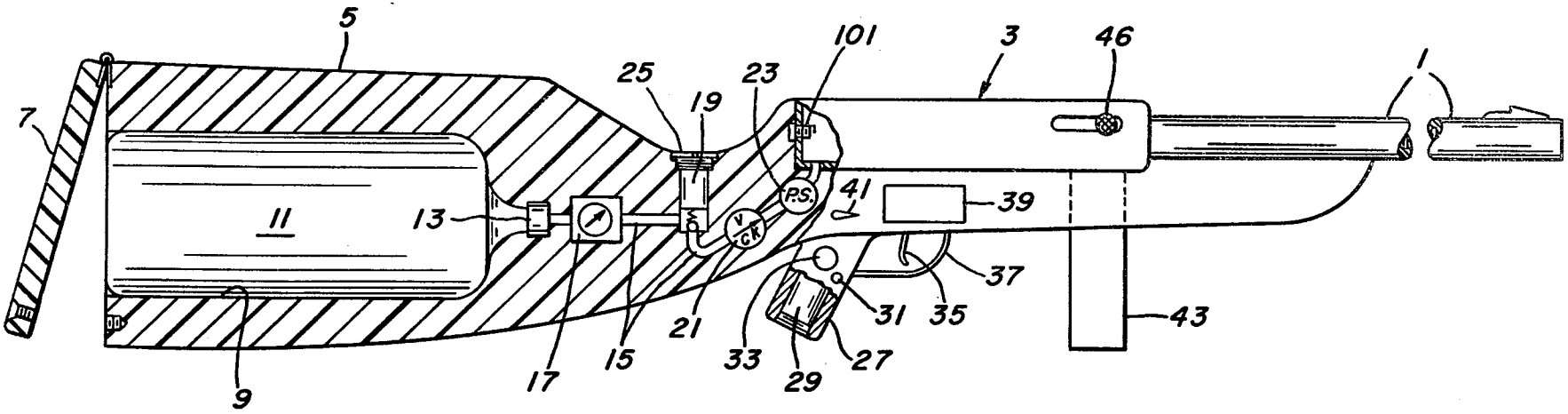
FIG. 1 is a side elevation view partially in section of a rifle embodying the invention.

The invention will be described as applied to a rifle as shown in FIG. 1 having a barrel 1, a breechblock 3 and a stock 5. The butt plate 7 of the stock is pivotally mounted to cover a recess 9 in the shoulder portion of the stock which receives a removable pressure bottle 11 containing pressurized fluid propellant for the weapon. The pressure bottle is locked into a receiver 13 and is connected by a conduit 15 through a pressure regulator 17, a solenoid vavle 19, a check valve 21 and pressure switch 23 to the breechblock 3.

The pressure regulator 17 is provided with a gauge which is mounted to give a visual indication of the pressure and, therefore indirectly, the amount of fluid propellant in the pressure bottle 11. The regulator also supplies fluid propellant through the conduit 15 at a preset but adjustable pressure. The solenoid valve 19 controls the flow of pressurized propellant through the conduit 15 as directed by a control circuit to be described below. The solenoid is retained in place in a bore in the stock by a water tight screw cap 25.

The check valve 21, which may suitably be a spring biased ball type, permits flow of pressurized fluid from the pressure bottle 11 to the breechblock 3 but prevents back flow when the weapon is fired. The pressure switch 23 operates two sets of contacts in the control circuit to be discussed below when the pressure in the last portion of the line 15 and therefore in the breechblock 3 is above a preset value. The pressure at which the pressure switch is actuated may be adjusted by a knob on the switch (not shown) which protrudes through the stock 5.

A pistol grip 27 on the stock 5 houses a battery 29 which may be tested by pressing the test button 31 and observing the level of charge on the gauge 33. The trigger 35 is pivotally mounted in front of the pistol grip 27 and is protected by a guard 37. The control circuitry 39 is removably mounted in a compartment in the stock adjacent the trigger 35 and an "OFF — SEMI-AUTO" mode switch 41 is mounted adjacent the compartment for the control circuit 39. A magazine 43 which can hold a supply of projectiles for feeding one at a time into the barrel is inserted through the underside of the stock into the breechblock 3.

Figure 2:
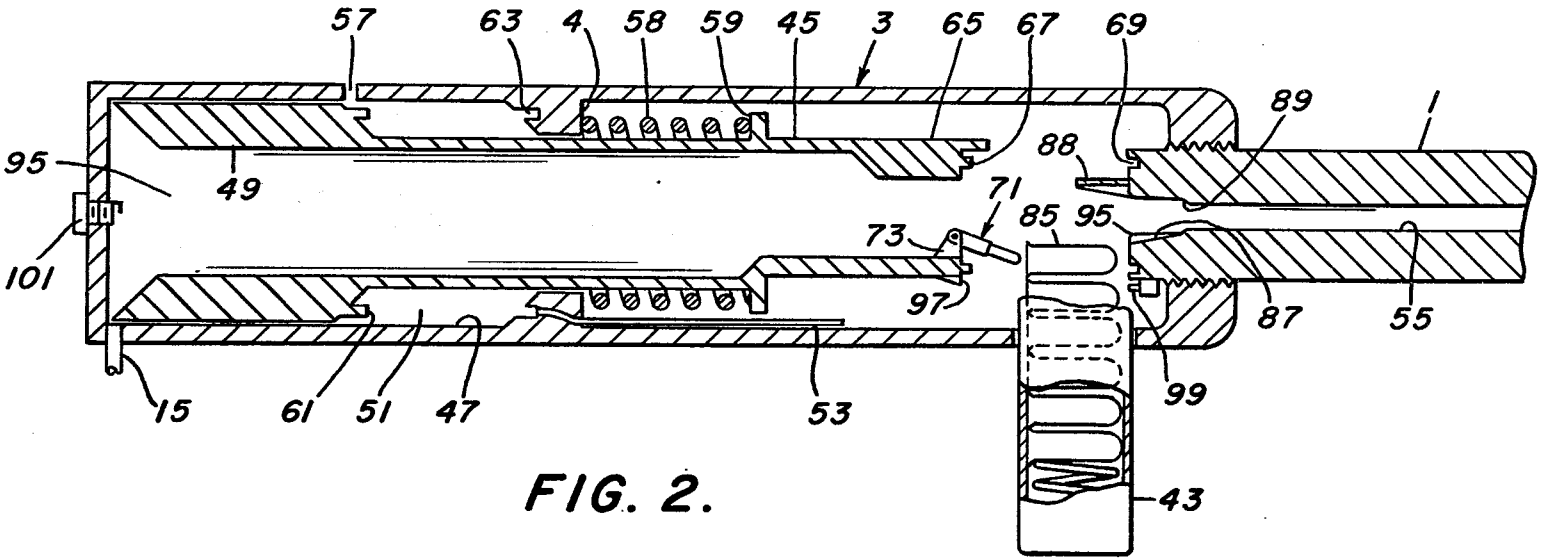
FIG. 2 is a schematic representation of a section through the breechblock of the rifle of FIG. 1.
Figure 3:
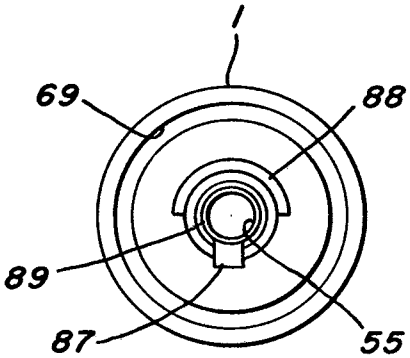
FIG. 3 is a vertical view of the breech end of the barrel of the rifle of FIG. 1.

FIG. 2 is a schematic representation of a section through the breechblock 3 and the end of the barrel 1. A hollow bolt 45 is received in an axial bore 47 in the breechblock 3 and is slidable between an open position wherein the bolt is moved all the way to the left, as shown in FIG. 2, and a closed position in which the bolt moves to the right to seat against the end of the barrel 1. The end portion 49 of the bolt received in the breechblock 3 is larger in diameter than the remainder of the bolt such that an annular blow back chamber 51 is formed between the bolt and the breechblock 3. A blow back line 53 which is connected to a point (not shown) in the bore 55 in the barrel 1 directs gases generated by ignition of the propellant back to the blow back chamber 51 as the projectile proceeds down the bore 55. These gases then drive the bolt toward the open position (the left as seen in FIG. 2) until the relief port 57 is uncovered and the gases escape to the atmosphere. A large coil spring 58, surrounding the bolt and bearing against a shoulder 4 in the breechblock 3 and an annular flange 59 on the bolt, is compressed as the bolt is driven to the open position by the blow back gases and then biases the bolt toward the closed position as the gases are relieved through the relief port 57. An annular sealing ring 61 on the face of the enlarged end portion 49 of the bolt seats in a mating annular recess 63 in the shoulder 4 of the breechblock as the bolt closes.

Figure 4:
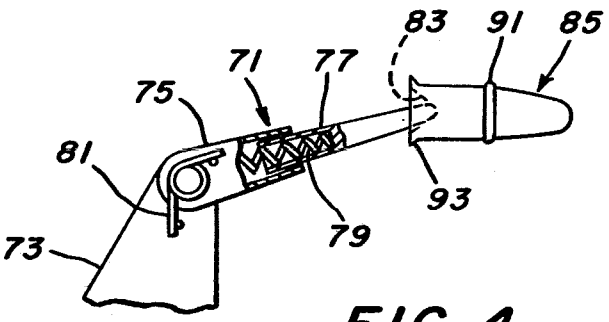
FIG. 4 is an enlarged vertical view, partially in section, of an injector finger of the rifle of FIG. 1 showing how it seats in the recess of a projectile.

The forward end 65 of the bolt 45 is also provided with an annular ring 67 on the face thereof which seats with a mating annular recess 69 in the barrel 1 to form a gas tight seal as the bolt closes. The bolt 45 may also be opened manually by the knurled lever 46 shown in FIG. 1. When the lever is released, the spring 58 drives the bolt to the closed position. The forward end of the bolt also carries an injector finger 71 pivotally mounted on a boss 73. As best seen in FIG. 4, the injector finger 71 comprises two telescoping sections 75 and 77 biased to the extended position by an internal spring 79. The injector finger 71 is biased downward and outward in the path of the closing bolt by a spring 81.

As the bolt is driven in the closing direction, the downward biased injector finger 71 enters the recess 83 in the rear of the top projectile 85 in the magazine 43 and urges the projectile forward and up a relieved portion 87 in the bottom center of the barrel into the bore 55. A hood 88 over the top of the bore assists in seating the projectile in the bore. The bore 55 is countersunk slightly to form a shoulder 89 against which a collar 91 on the projectile seats. The projectile is cast with a flashing 93 on the rear which serves as a seal for the forward end of the firing chamber 95 formed by the bore in the hollow bolt 45, the end of the barrel 1 and the closed end of the breechblock 3. The spring biased injector finger 71 retains the projectile in sealing engagement with the end of the barrel until the weapon is fired. As the bolt 45 closes, a projection 97 on the underside of the bolt which assists the injector finger 71 in inserting the projectile 85 into the bore 55, actuates a bolt closed switch 99 to prepare circuits discussed below for the introduction of the propellant into the firing chamber 95. The pressurized fluid propellant when introduced into the firing chamber 95 through the conduit 15 also bears against the rear of the projectile 85 and retains it in place. Upon actuation of the trigger 35, the pressurized propellant in the firing chamber 95 is ignited by the spark plug 101 through circuitry to be described below. The explosive ignition of the propellant drives the projectile 85 down the bore 55 of the barrel. The flashing 93 on the projectile 85 collapses under the tremendous forces generated, however, the collar 91 on the projectile forms a gas tight seal with the tapered bore 55 and thereby permits the generation of a very high muzzle velocity.

Figure 5:
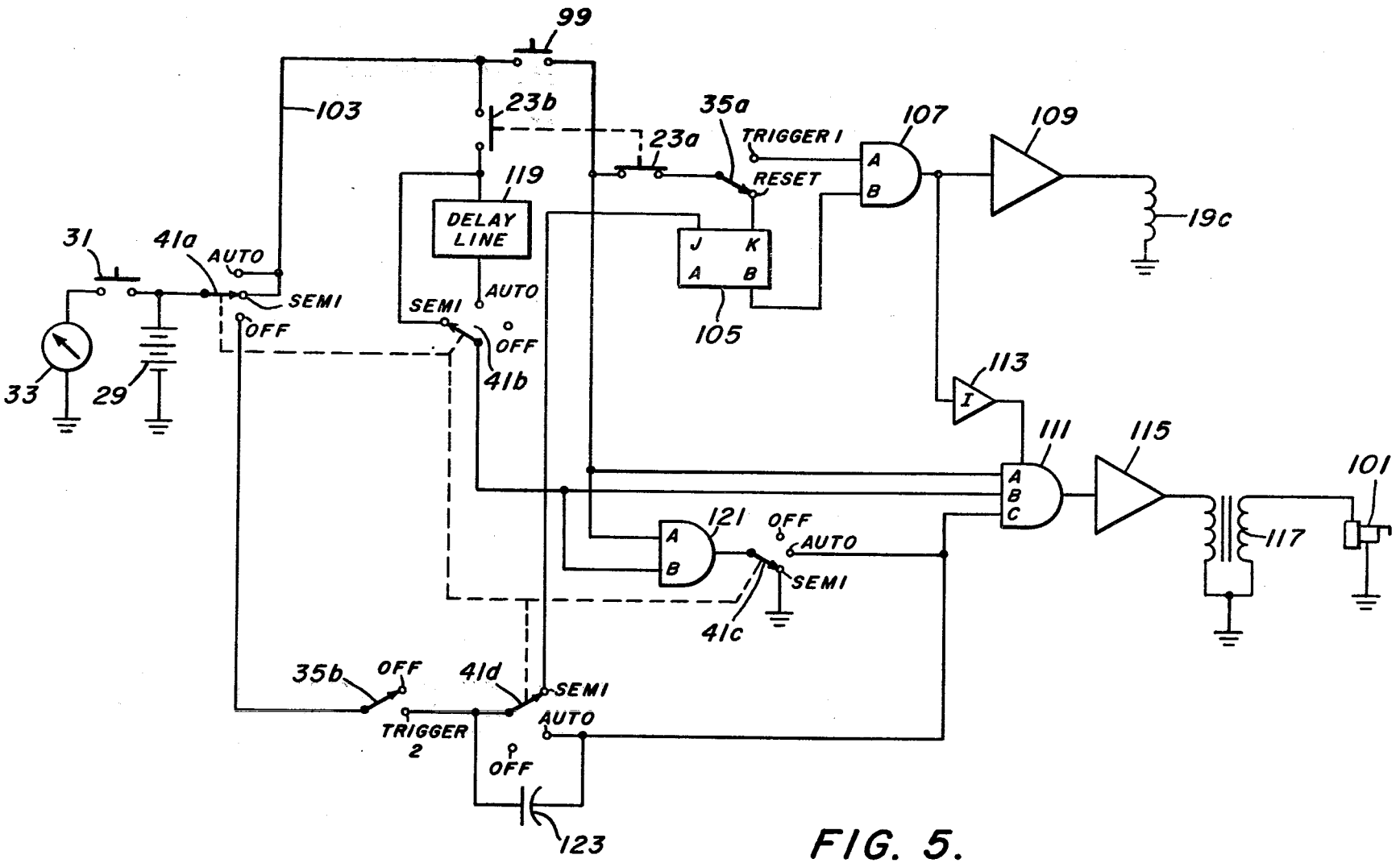
FIG. 5 is a schematic diagram of a circuit suitable for operating the rifle of FIG. 1 in accordance with the principles of the invention.

FIG. 5 illustrates a suitable circuit for operation of the disclosed projectile firing device. The battery 29, which may be tested by pressing the push button 31 to give a visual indication on gauge 33 of the state of the battery charge, is connected through the mode switch 41 to a lead 103. The mode switch 41 comprises four ganged three position switches 41 "a" through "d" each having a "semi" position, and an "auto" position and an inoperative "off" position. The lead 103 is connected, through the normally open contacts of bolt closed switch 99, a normally closed set of contacts 23*a* on pressure switch 23 and a trigger actuated switch 35*a*, to either the K input of a J-K flip-flop 105 or one input of AND gate 107. The switch 99 is closed when the bolt is in the fully closed position. The contacts 23*a* of pressure switch 23 are closed when the pressure in the firing chamber 95 is below the preset value and open above that pressure. The switch 35*a* is actuated by the trigger 35 and remains in the RESET position as shown in FIG. 5 when the trigger is unactuated but transfers to the TRIGGER 1 position upon initial squeezing of the trigger and remains in this position until the trigger is completely released.

AND gate 107, when turned on by the TRIGGER 1 output of switch 35*a* and the B output of flip-flop 105, energizes the coil 19*c* of solenoid valve 19 through driver 109 and when turned off enables AND gate 111 through inverter 113. AND gate 111 when turned on generates a firing pulse for spark plug 101 through driver 115 and high voltage transfer 117. AND gate 111 is turned on by a signal applied to the A input when the bolt switch 99 is closed, a signal applied to the B input through switch 41*b* when the pressure in the firing chamber is above the present valve so that the contacts 23*b* of pressure switch 23 are closed either directly when switch 41*b* is in the SEMI position or through variable DELAY LINE 119 when switch 41*b* is in the AUTO position, and by a signal applied to input C either through switches 35*b* and 41*d* in either the AUTO or SEMI modes, or, alternately in the AUTO mode, by the output of AND gate 121. Switch 35*b* is in the TRIGGER 2 position to apply the required signal only when the trigger 35 is fully depressed. When switch 41*d* is in the SEMI position, a pulse is applied to input C of AND 111 through capacitor 123. AND 121 is turned on by a signal applied to its A input when the bolt switch 99 is closed and a signal applied to the B input from switch 41*b*. AND 121 only supplies an activating signal to AND 111 when the switch 41*c* is in AUTO.

The above described device operates in the following manner. It will be assumed first that the mode switch 41 is turned to the SEMI position. The operator pulls the lever 46 to slide the bolt 45 rearward and releases it so that the spring 58 drives the bolt toward the closed position. As the bolt 45 moves forward the injector finger 71 slides a projectile 85 from the magazine 43 into the bore 55 in the barrel. As the bolt reaches the fully closed position, the bolt switch 99 is closed which applies a signal to the K input of flip-flop 105 to insure that the flip-flop output is high.

When the operator begins to pull the trigger 35, switch 35*a* transfers to the TRIGGER 1 position thereby turning on AND 107 which in turn energizes solenoid valve 19. As solenoid valve 19 opens, pressurized propellant flows from the bottle 11 through conduit 15 to the firing chamber 95. While the firing chamber is being charged with propellant, the inverter 113 disables AND 111 so that the spark plug 101 cannot be energized to ignite the propellant prematurely. When the pressure in the firing chamber 95 reaches the preset value, pressure switch 23 is actuated to open contacts 23*a* thereby turning off AND 107 which deenergizes solenoid 19 and enables AND 111. At the same time the contacts 23*b* of the pressure switch close to cause the B input of AND 111 to go high. The A input is already high due to the signal applied through the bolt closed switch 99. When the operator depresses the trigger all the way, the switch 35*b* is transferred to the TRIGGER 2 position which applies a pulse through capacitor 123 to turn on AND 111 thereby energizing the spark plug 101 and igniting the propellant. At the same time, a signal is applied to the J input of flip-flop 105 to cause the output to go low and prevent turn on of AND 107 as the pressure in the firing chamber decreases and contacts 23*a* reclose following discharge of the projectile from the barrel.

As the projectile proceeds down the barrel under the urging of the gases generated by ignition of the propellant, a portion of these gases enter the conduit 53 and are fed back to the blow back chamber 51 where they drive the bolt rearward thereby opening bolt switch 99. As the bolt reaches the fully open position, the blow back gases are relieved through relief port 57 and the spring 58 drives the bolt 45 forward again to transfer another projectile 85 from the magazine 43 to the bore 55.

With the mode switch 41 in the SEMI position, the firing chamber cannot be recharged with propellant even though both switch 99 and contacts 23*a* reclose, unless the trigger is fully released to return the switch 35*a* to the reset position to again set the output of flip-flop 105 high. This ensures that only one projectile may be fired with each squeeze of the trigger in the SEMI mode. However, by releasing and resqueezing the trigger, all of the projectiles in the magazine can be fired one after the other. When no more projectiles 85 remain in the magazine, the downwardly biased injector finger 71 will prevent full closure of the bolt 45 following firing of the last round and therefore the bolt close switch 99 will remain open. With this switch open, it can be seen from the circuit of FIG. 5 that propellant cannot be introduced into the firing chamber. This feature prevents depletion of propellant through the bore in the barrel when it is not plugged with a projectile.

When the mode switch 41 is placed in the AUTO position, the firing chamber 95 is initially charged with propellant in the manner described above as the trigger 35 moves out of the rest position. AND 111 is also enabled by inverter 113 when the firing chamber is fully charged as in the SEMI mode. In addition, the bolt closed switch 99 causes input A of AND 111 to go high. However, input B of AND 111 only goes high a predetermined time interval after the firing chamber 95 is charged and pressure switch contacts 23*b* close because switch 41*b* now introduces delay line 119 into the circuit. This time delay may be set at any desired interval to vary the rate of fire in the AUTO mode. An adjustment knob can be provided on the delay circuit for this purpose. As the trigger is fully squeezed, switch 35*b* goes to TRIGGER 2 to apply a signal to the C input of AND 111 through switch 41*d* and the spark plug 101 is fired. The projectile 85 is driven down the barrel and the bolt recycles to load another projectile into the barrel in the same manner as in the SEMI mode.

With the trigger 35 held in the TRIGGER 2 position and the mode switch in AUTO, a continuous high signal is applied to the C input of AND 111. However, when the bolt switch 99 recloses and AND 107 turns on to recharge the firing chamber with propellant, inverter 113 disables AND 111. Even when the firing chamber is recharged and pressure switch 23*b* closes, AND 111 is not turned on to ignite the propellant until the preset time delay set by delay line 119 again expires Thus as long as the trigger 35 remains actuated, the projectiles will be propelled down the barrel automatically one after the other at intervals determined by the delay line 119. When the trigger is released in AUTO, AND 121 will still cause the C input of AND 111 to go high to send a firing signal to the spark plug 101. However, with the trigger released, the A input to AND 107 will not go high when the bolt closes after firing the last round, and therefore the firing chamber will not be recharged with propellant. This feature assures that the firing chamber does not remain charged with propellant after the trigger is released in the automatic mode. As in the case of the semi-automatic mode, when no more projectiles remain in the magazine as the bolt moves forward, it is prevented from fully closing and actuating the bolt closed switch 99 by the downwardly biased injection finger 71. If desired, other means could be used to assure that propellant is not introduced into the firing chamber when no projectile is inserted in the bore to form a seal.

Suitable propellants could be either gases or liquids at standard temperature and pressure. The propellant should have a high energy of reaction yet be stable under conditions in which the device would be used. Suggested propellants would include stoichiometric mixtures of oxygen with a hydrocarbon such as methane or a cyclo-alkane, or an unsaturated hydrocarbon such as acetylene, a cyclo-alkane or an arene. Other possible propellants would include nitro derivatives of hydrocarbon compounds such as trinitrotoluene. Where it is desirable to maintain the oxidizer separate from the propellant prior to firing the device, separate pressure bottles with appropriate valving in accordance with the teachings of the invention may be provided.

While the invention is disclosed as applied to a rifle, it is readily apparent that it is adaptable for use in other weapons systems. Some modifications may be desirable in such applications. For instance, in larger devices for use in tanks, ships, airplanes or fixed installations, the propellant source can be separate from the remainder of the device. In some applications it may be desirable that the charging signal, which initiates flow of propellant to the firing chamber, be provided by means independent of initial movement of the trigger. Other variations fully within the teachings of the invention are also possible and the invention is to be given the full scope of the appended claims.

We claim:

1. A projectile firing device comprising:

a barrel;

a breechblock containing a firing chamber mounted on one end of the barrel with the firing chamber in communication with the barrel;

a bolt slidable within the firing chamber of the breechblock between an open position in which a projectile may be inserted into said one end of the barrel and a closed position in which the firing chamber is sealed;

a source of fluid propellant under pressure;

means connecting the source of pressurized fluid propellant with the firing chamber;

valve means in said connecting means for controlling the flow of said pressurized fluid propellant from said source to the firing chamber;

triggering means including a trigger, electrical means responsive to movement of the trigger to electrically ignite the propellant in the firing chamber, and means for enabling said electrical means;

means for generating a charging signal; and control means responsive to pressure in the firing chamber below a predetermined value, said bolt being in the closed position and said charging signal, to open said valve means to permit flow of the pressurized propellant from said source into the firing chamber, and further responsive to pressure in the firing chamber above said predetermined value to close said valve means and activate said enabling means, whereby generation of said charging signal with the bolt closed, charges said firing chamber with propellant and actuation of said trigger electrically ignites the propellant to drive the projectile down the barrel.

2. The apparatus of claim 1 wherein said charging signal generating means is connected to said trigger and generates said charging signal upon initial movement of the trigger.

3. The device of claim 1 including adjustable pressure regulating means in said connecting means for regulating the pressure of the propellant delivered to the firing chamber whereby the mass of the charge of propellant introduced into the firing chamber and therefore the velocity attained by the projectile is readily adjustable.

4. The device of claim 1 including:

a magazine connected to the breechblock for storing a plurality of projectiles;

means utilizing the gases generated by ignition of the propellant for driving the bolt toward said open position as the projectile proceeds down the barrel;

biasing means for returning said bolt to the closed position; and means connected to said bolt for transferring a projectile from said magazine into said one end of the barrel as said bolt is driven from the open position to said closed position and for preventing said control means from opening said valve means to recharge the firing chamber with propellant when no projectiles remain in the magazine as the bolt is driven by the biasing means toward the closed position whereby a projectile is automatically inserted into said one end of the barrel following firing of the device and further transfer of propellant to the firing chamber is inhibited when no projectiles remain in the magazine.

5. The device of claim 4 wherein the means for transferring projectiles from the magazine to the barrel and for preventing the control means from transferring propellant to the firing chamber when no projectiles remain in the magazine include means for preventing said bolt from reaching the fully closed position when no projectiles remain in the magazine.

6. The device of claim 5 wherein said projectiles are provided with a recess in the rear portion thereof and wherein said means for transferring said projectiles and for preventing the bolt from reaching the fully closed position when no projectiles remain in the magazine comprises a finger pivotally mounted to the bolt and biased outwardly to engage the recess in a projectile in the magazine to drive the same along inclined guides into said one end of the barrel, said outwardly biased finger pivoting with the movement of the projectile to permit closure of the bolt but remaining outwardly biased to prevent closure of the bolt when no projectiles remain in the magazine as said bolt is driven toward the closed position.

7. The device of claim 4 including mode means selectable to a semi-automatic condition to prevent the control means from opening the valve means to recharge the firing chamber with propellant following ignition of the propellant until said trigger is released and reactuated, and selectable to an automatic condition to permit said control means to operate the valve means to repeatedly recharge said firing chamber with propellant and to enable the electrical means to ignite the new charge of propellant as long as the trigger remains actuated.

8. The device of claim 7 wherein said selectable mode means includes means when in said automatic condition to actuate said electrical means to ignite propellant in said firing chamber when the trigger is released and the pressure in said firing chamber is above said preset value whereby no unignited charge of propellant remains in the firing chamber upon release of the trigger.

9. The device of claim 7 wherein said selectable mode means includes means when in said automatic condition to generate and adjustable time delay and wherein said enabling means is responsive to the time delay to delay ignition of the propellant by the electrical means for said adjustable time delay whereby the rate of fire in said automatic mode is adjustable.

10. The device of claim 9 wherein said time delay means is responsive to the pressure in the firing chamber and delays ignition of the propellant the adjustable time interval after said pressure reaches said preset value.

* * * * *